US008806678B2

(12) United States Patent
Michael

(10) Patent No.: US 8,806,678 B2
(45) **Date of Patent: *Aug. 19, 2014**

(54) ENCASEMENT

(75) Inventor: Petra J. Michael, Carlsbad, CA (US)

(73) Assignee: SkyBlue Textiles LLC, Carlsbad, CA (US)

( * ) Notice: Subject to any disclaimer, the term of this patent is extended or adjusted under 35 U.S.C. 154(b) by 536 days.

This patent is subject to a terminal disclaimer.

(21) Appl. No.: 12/985,175

(22) Filed: Jan. 5, 2011

(65) Prior Publication Data

US 2012/0167301 A1 Jul. 5, 2012

(51) Int. Cl.
*A47G 9/02* (2006.01)

(52) U.S. Cl.
USPC ..... 5/482; 5/499; 5/495

(58) Field of Classification Search
USPC ..... 5/494, 499, 699, 482, 484
See application file for complete search history.

(56) References Cited

U.S. PATENT DOCUMENTS

| | | | | |
|---|---|---|---|---|
| 3,530,487 | A | 9/1970 | Beer et al. | |
| 4,815,176 | A | 3/1989 | Yoshida | |
| 5,279,009 | A | 1/1994 | Putka, Jr. | |
| 5,586,368 | A | 12/1996 | Nelson | |
| 5,745,940 | A | 5/1998 | Roberts et al. | |
| 6,105,213 | A | 8/2000 | Ye | |
| 6,189,249 | B1 | 2/2001 | Hughes | |
| 6,269,504 | B1 | 8/2001 | Romano et al. | |
| 6,357,086 | B1 | 3/2002 | Ye | |
| 7,200,901 | B2 | 4/2007 | Pitts et al. | |
| 7,487,560 | B2 | 2/2009 | McGrath et al. | |
| 7,552,489 | B2 | 6/2009 | Bell et al. | |
| 7,849,543 | B2 | 12/2010 | Poston, Jr. et al. | |
| 8,087,111 | B2 * | 1/2012 | Paris | 5/499 |
| 8,156,588 | B2 * | 4/2012 | Svoboda | 5/699 |
| 2009/0083908 | A1 | 4/2009 | Fry | |
| 2010/0281614 | A1 | 11/2010 | Park | |
| 2011/0099714 | A1 | 5/2011 | Svoboda | |
| 2012/0102646 | A1 * | 5/2012 | Chen et al. | 5/499 |

FOREIGN PATENT DOCUMENTS

| | | | |
|---|---|---|---|
| DE | 19629607 | A1 | 1/1998 |
| DE | 202007012017 | U1 | 12/2007 |
| JP | 2009095474 | A | 5/2009 |

OTHER PUBLICATIONS

JP 2009-95474 translation.*
Written Opinion & International Search Report dated Apr. 27, 2012 (PCT/US2011/067536).

* cited by examiner

*Primary Examiner* — Peter M Cuomo
*Assistant Examiner* — Brittany Wilson
(74) *Attorney, Agent, or Firm* — Quarles & Brady LLP

(57) ABSTRACT

An encasement for a bedding item includes a cover comprising a top portion, a bottom portion, and a side wall attaching the top portion to the bottom portion, an opening in the side wall sized to permit a bedding item to be removably inserted into an interior of the encasement, a zipper disposed in the opening of the side wall configured to reversibly seal the encasement, the zipper comprising an open end, a closed end, a zipper pull, and opposing complementary zipper tracks, and a zipper end stop disposed at the closed end of the zipper, the zipper end stop comprising an interior support panel attached to the top portion and the bottom portion of the cover beneath the zipper, a first securement means affixed to the interior support panel adjacent the zipper tracks, and a plurality securement members associated with the opposing complementary zipper tracks. Closing the zipper forms a beg bug impervious seal.

20 Claims, 4 Drawing Sheets

ENCASEMENT

CROSS REFERENCE TO RELATED APPLICATIONS

None

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

Devices for protecting bedding items are disclosed herein.

2. Description of the Background of the Invention

In recent years, bed bugs have made a comeback in the U.S. They are increasingly being encountered in homes, apartments, hotels, motels, health care facilities, dormitories, shelters, schools, modes of transport, and the like. Bed bugs are small, brownish, flattened parasitic insects that feed solely on the blood of animals. The common bed bug, *Cimex lectularius*, is the species most adapted to living with humans. Bed bugs may gain access into mattresses and the like, for example, through stitch holes made in the top, side and/or bottom surfaces during the quilting process. Once inside a mattress or similar refuge, bed bugs pierce the mattress fabric by means of a proboscis to bite those resting on the mattress. Bed bugs are active mainly at night. During the daytime, they prefer to hide close to where people sleep. Their flattened bodies enable them to fit into tiny crevices, especially those associated with mattresses, box springs, bed frames, headboards, and the like.

In response to the resurgence of bed bugs, encasements for mattresses, box springs, sofas, pillows, and the like, have become available on the market that have a variety of features aimed at preventing bed bugs from entering and escaping the encasements. However, there are numerous shortcomings in encasement design characteristics and materials that may present potential problems for consumers.

In one example, due to the fabric used in certain mattress encasements, air flow is restricted through the encasement walls which promotes molding of the mattress. In a further example, fabric choice has proven to be problematic in certain applications. Specifically, the use of nonwoven fabrics for box spring encasements may lead to rips, tears, and/or cuts in the fabric due to contact with sharp plastic corner pieces of box springs and/or metal bed frames.

In another example, mattress encasements have been designed to fit various mattress depths by the incorporation of elastic into the design. However, this design provides significant bed bug harborage points, as the elastic forms a fold over the length of the zipper where bed bugs may hide. In a further example, certain mattress encasements use zippers with large teeth that leave holes at the closed end of the zipper. Such holes provide direct access points into and out of the encasement for bed bugs. Furthermore, the bed bugs can weave their way through the zipper teeth and enter or escape the encasement.

To prevent the forming of holes due to the zipper pulling open during normal use, certain mattress encasements use hook closures to secure the zipper pulls to the closed end of the zipper. However, such hook closures may be inadvertently opened, for example, due to normal use of the mattress, such as when the bed is made, or by changing the sheets or mattress cover. In addition, the metal hooks used in the hook closures may rub against and cut threads that hold the hooks in place, which could form a hole that would allow bed bugs to go in and out of the encasement.

For reasons such as these, improved encasements are needed to protect consumers from the problems imposed by parasites and/or insects, such as bed bugs.

SUMMARY OF THE INVENTION

According to one aspect of the present disclosure, an encasement for a mattress or box spring includes a cover comprising a top portion, a bottom portion, and a side wall attaching the top portion to the bottom portion, an opening in the side wall sized to permit a mattress or a box spring to be removably inserted into an interior of the encasement, and a zipper disposed in the opening of the side wall configured to reversibly seal the encasement. The zipper includes an open end, a closed end, a zipper pull, and opposing complementary zipper tracks. The encasement further includes a zipper end stop disposed at the closed end of the zipper, the zipper end stop having an interior support panel attached to the top portion and the bottom portion of the cover beneath the zipper, a first securement means affixed to the interior support panel adjacent the zipper tracks, and a plurality of securement members associated with the opposing complementary zipper tracks. Movement of the zipper pull from the open end to the closed end closes the opening to seal the encasement and secures the complementary securement members to the first securement means to form a beg bug impervious seal.

According to another aspect of the present disclosure, a bed bug encasement includes a cover having a top portion attached to a bottom portion via a side wall. The top portion and the bottom portion are bed bug bite proof. The encasement further includes an opening in the side wall sized to permit a mattress or box spring to be removably inserted into an interior of the encasement, a zipper disposed in the opening of the side wall configured to reversibly seal the encasement, the zipper comprising a zipper pull and opposing complementary zipper tracks, and a zipper end stop disposed at a closed end of the zipper. The zipper end stop includes an interior support panel attached to the top portion and the bottom portion of the cover beneath the zipper, a first securement means affixed to the interior support panel adjacent the zipper tracks, and a plurality of securement members associated with the opposing complementary zipper tracks. Closure of the zipper associates the zipper pull with the closed end to close the opening and secures the complementary securement members to the first securement means to form a beg bug impervious seal.

According to a further aspect of the present disclosure, a bed bug invasion and escape-proof encasement includes a cover having a top portion attached to a bottom portion via a side wall. The top portion and the bottom portion protect against bed bug bites therethrough. The encasement further includes an opening in the side wall sized to permit a mattress or box spring to be removably inserted into an interior of the encasement, a zipper disposed in the opening of the side wall configured to reversibly seal the encasement, the zipper comprising a zipper pull and a first zipper track and a second zipper track, and a zipper end stop disposed at a closed end of the zipper. The zipper end stop includes an interior support panel attached to the top portion and the bottom portion of the cover beneath the zipper, a strip of loop material affixed to the interior support panel having a width greater than the zipper tracks when enmeshed, and a first strip of hook material attached to an inner surface of the first zipper track and a second strip of hook material attached to an inner surface of the second zipper track. Closure of the zipper reversibly fastens the first strip of hook material and the second strip of hook material to the strip of loop material to form a seal that prevents a beg bug from passing through the zipper end stop.

DETAILED DESCRIPTION

The present disclosure relates to protective encasements for bedding items. In one embodiment, contemplated encasements protect bedding items sealed therein from infestation of bed bugs and other parasites. The encasements of the present disclosure may be used for bedding items, including, for example, a mattress, a box spring, a pillow, a pad, or a cushion. It is further envisioned that encasements of the present disclosure may be used for storage. For example, contemplated encasements may be used for storage of textiles, fabrics, and bedding items includes sheets, mattress covers, blankets, clothing, and the like. For example, in one embodiment, encasements contemplated herein may take the form of a garment bag, luggage, storage containers, animal pillow covers, and the like. In this way, a consumer may further protect themselves and their possessions from parasite infestation, such as bed bugs.

in another embodiment, encasements of the present disclosure may be factory installed or incorporated into the construction of the bedding item. For example, during manufacture, current box springs are padded, covered with fabric on 5 sides, and a dust cover is stapled to the bottom. It is envisioned that companies that produce box springs (or other bedding items) would benefit by replacing the conventional fabrics used in box spring manufacture with a bed bug encasement of the present disclosure. In this way, all future box springs would come from the factory with a pre-installed encasement rather than the currently used fabric and dust cover. The perceived advantage may overcome any extra manufacture-associated cost by eliminating the aftermarket installation costs. Such an approach may have even greater advantages for companies that have large scale use of bedding items, such as hotels, cruise ships, and the like.

Figure 1:
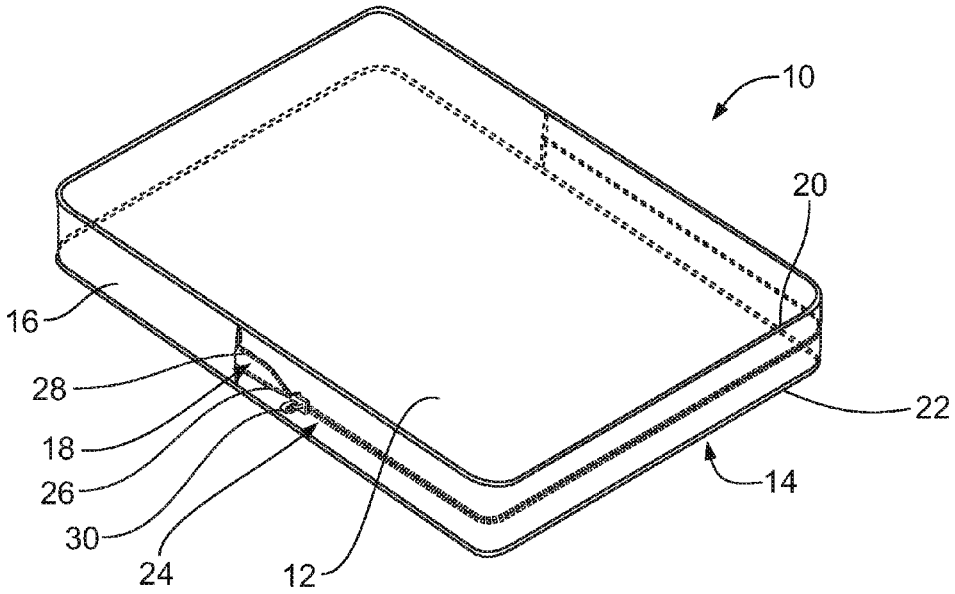
FIG. 1 is a perspective view of an encasement contemplated herein.

In one embodiment, as depicted in FIG. 1, an encasement 10 may include a top cover 12, a bottom cover 14, and a sidewall 16 or raise with an opening 18 therein. The top cover 12 and sidewall 16 are joined at an upper seam 20, and the bottom cover 14 and sidewall are joined at a lower 22 seam. The upper 20 and lower 22 seams may be formed by stitching (not shown) or other means known in the art that create impervious joints through which parasites, such as bed bugs may not enter or exit. One example of such impervious joints includes a stitched seam, including, for example, a French seam. Other contemplated seams may be formed by welding and/or an adhesive. A zipper 24 including complementary first 26 and second 28 zipper tracks and a zipper pull 30 is secured within the opening 18 by known means, such as stitching, to reversibly open and close the opening 18 to allow a bedding item (not shown) to be removably placed within the encasement 10 and sealed therein. While discussed herein in terms of a zipper, the closure for the contemplated encasements may include other suitable means for forming a bed bug proof seal, such as at least one of a hook and loop fastener, an adhesive, an adhesive silicone, a magnet and ferrous material, complementary male and female mating strips of a plastic zipper with or without a slider, and the like. The opening 18 in the sidewall 16, as depicted in FIG. 1, may be substantially sized to allow bedding items of various sizes, including, for example, a mattress or box spring, to be placed into the encasement 10 when the zipper 24 is completely unzipped. Therefore, various sizes of encasements and openings are contemplated. Further, while the encasement 10 is depicted in FIG. 1 to have a substantially rectangular shape, similar to a mattress or box spring, encasements of the present disclosure may have any desired shape. Still further, encasements may be designed for particular bedding items based on shape and/or size, including, for example, crib, single, twin XL, full, full XL, queen, and king-sized mattresses, including, for example, hotel king, cal king, and eastern king, and/or corresponding box springs.

In yet a further embodiment, encasements may incorporate one or more layers of cushioning associated with at least one of the top layer or the bottom layer. For example, a layer of cushioning may include at least one of a foam, a gel, feathers, a fabric, micro beads, and combinations thereof.

Figure 2:
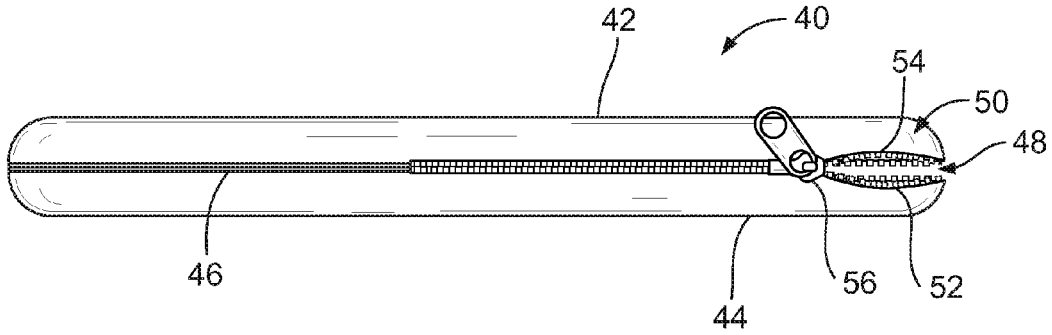
FIG. 2 is a front plan view of an another encasement contemplated herein.

In another embodiment shown in FIG. 2, an encasement 40 may include a top cover 42 and a bottom cover 44 that are partially joined to each other along a seam 46. The encasement 40 may have an opening 48 spaced between the top 42 and bottom 44 covers through which bedding items or other items for storage may be inserted and removed. A zipper 50 including complementary first 52 and second 54 zipper tracks and a zipper pull 56 may be disposed within the opening 48 to reversibly open and close the opening to allow an item (not shown) to be placed within the encasement 40 and sealed therein. In this embodiment, a sidewall is not needed.

Materials that may be used for the top cover, bottom cover, and sidewall typically will include one or more of a woven material, a nonwoven material, a fabric, a textile, a plastic, a rubber, a silicone, a foam, a laminate, a leather, and combinations thereof. For example, materials that may be used for the encasements of the present disclosure include cotton, cotton blends, micro fiber, polyester fiber, and polyester fiber blends, recycled textiles, blended textiles, wool, wool blends, lyocell, available from TENCEL® and as LYOCELL BY LENZING®, a cellulose fiber, textiles with an elastic fiber content, silk, silk blends, and combinations thereof. In one embodiment, materials that are prone to ripping, tearing, and/or cutting, such as nonwovens, and the like are less desirable for use in encasements where the encasements are likely to encounter hard and/or sharp edges or surfaces, such as plastic corner pieces of box springs and metal bed frames. However, any desired material or combinations thereof may be used for encasements contemplated herein.

In one embodiment, fabric used for the top cover, where contact with a person or animal is more likely, and the bottom cover is bite proof, for example, bed bug bite proof, meaning that a parasite and/or insect, for example, cannot pierce through the fabric to reach the person or animal to feed. For example, bed bug bite proof material would prevent the proboscis of the bed bug penetrating through the fabric to reach the person or animal resting thereon. Examples of bed bug bite proof materials that may be used for the encasements of the present disclosure include plastics, rubber, a silicone, and/or leather. Further examples of bed bug bite proof materials include laminated and/or coated materials. For example, all materials contemplated herein may be laminated and/or with another material to provide a bed bug bite impervious material. In one example, a polyurethane film laminate may be used. Additional laminates and/or coatings are contemplated herein that render the fabric bed bug bite proof.

In another embodiment, it is contemplated that the sidewall or raise may be made out of penetration-proof fabric, meaning this fabric may not necessarily be bite proof, but would still prevent parasites, insects, bed bugs, and the like, from entering or exiting the encasement. Further, the material forming the sidewall will help prevent the contents of the encasement from mold or mildew formation while encapsulated by the encasement. In one embodiment, the sidewall is made without a polyurethane lamination or other bed bug bite impervious coating, or only partially laminated and/or coated, or made without airflow restrictive fabrics and/or materials to help ensure proper airflow to prevent mold formation. It is also envisioned that parasite proof vents may be incorporated into the top and/or bottom cover and/or the side walls to help prevent mold or mildew formation and to otherwise keep the encasement contents from acquiring a moldy smell.

In a further embodiment, the entire encasement may be made with fabric that is not bite proof. It is contemplated that such encasements could be used to protect box springs, as people and animals do not sleep directly on the box spring. Similarly, such encasements may be used for storage of items as discussed herein.

Figure 3:
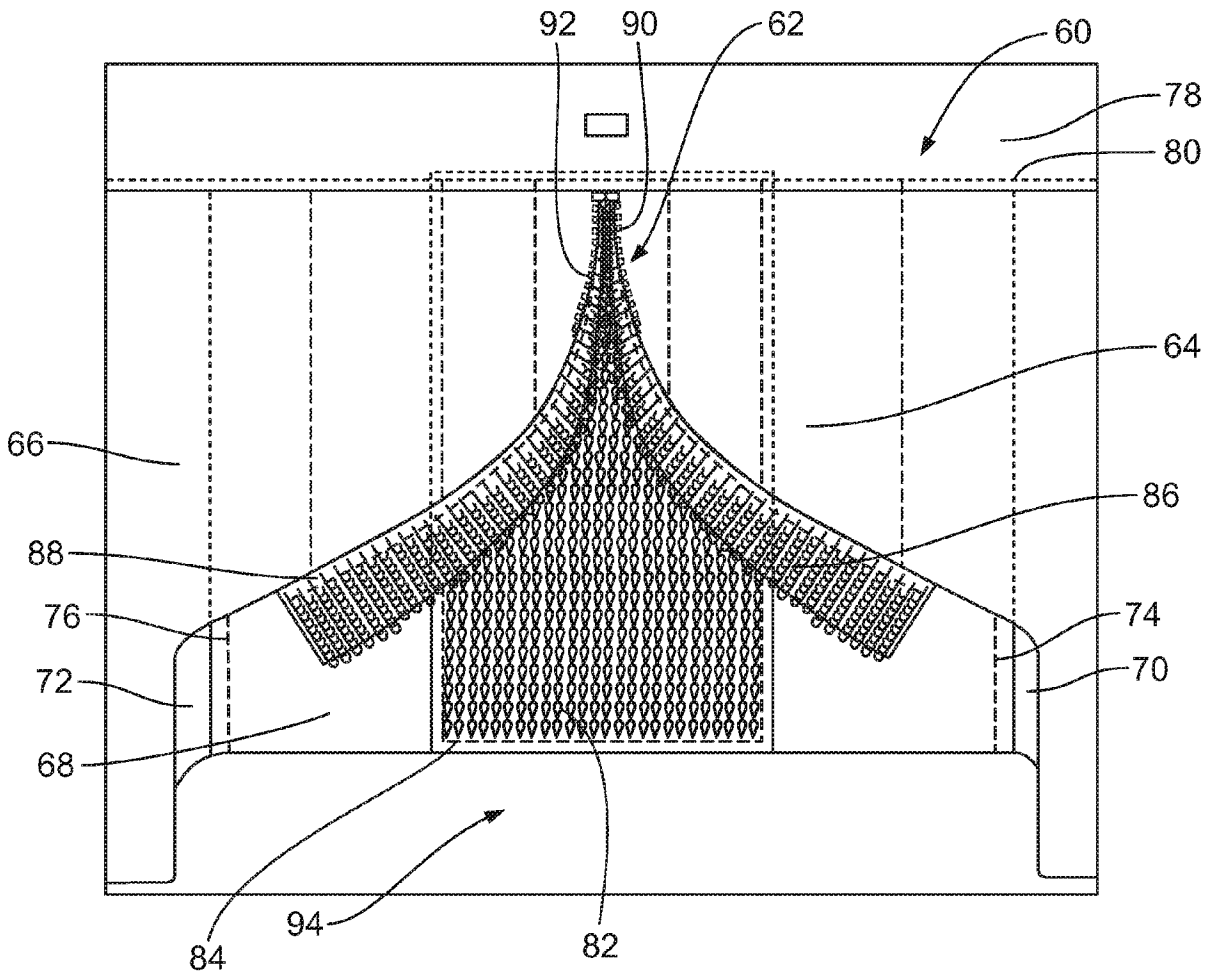
FIG. 3 is a top plan view of an opened zipper end stop.

Encasements contemplated herein may further include a zipper end stop 60, for example, as depicted in FIG. 3. FIG. 3 depicts the zipper end stop 60, where the zipper 62 is open and upper 64 and lower 66 sidewall portions are pealed back to reveal a support panel 68. The support panel is attached to both the top cover 70 and the bottom cover 72 at first 74 and second 76 inner seams, respectively, and to the sidewall 78 at a third inner seam 80. A first securement means 82 is affixed to the support panel 68, for example, by stitching 84. First 86 and second 88 securement members are attached to the inner side of the first 90 and second 92 complementary zipper tracks, respectively. The first securement means 82 and the first 86 and second 88 securement members are complementary, in that, association of the first securement means 82 with the first 86 and second 88 securement members creates a strong adhesive effect and/or bond and/or impervious seal that prohibits passage of parasites and/or insects, such as, for example, bed bugs, into and out of the encasement.

In practice, when a user closes the opening 94 by zipping closed the zipper 62, the zipper pull (not shown) enmeshes the first 90 and second 92 complementary zipper tracks as the zipper pull advances. As the zipper pull passes over the support panel 68, the first 86 and second 88 securement members are oriented over the first securement means 82 to form a reversible bond with the first and second securement members and an impassible channel beneath the enmeshed zipper tracks 90, 92 along which the zipper pull passes when opening or closing the encasement.

It is contemplated that any suitable zipper may be used that prevents entry or exit of parasites and/or insects, such as bed bugs. For example, zippers having microteeth may be used in the present disclosure, as microteeth prevent bed bugs of all life stages from passage therethrough. Securement members and securement means contemplated herein may be of sufficient size, for example, length and/or width to ensure the formation of an impassible seal when the encasement is closed. For example, the support panel may extend several inches along the zipper from the closed end. It is envisioned that the securement members and securement means may be of similar length or longer or shorter and have varying widths that ensure an impenetrable seal. Securement members and securement means contemplated herein may include at least one of a hook and loop fastener, an adhesive, an adhesive silicone, a magnet and ferrous material, complementary male and female mating strips of a plastic zipper, and the like. For example, in the context of FIG. 3, when the securement means 82 and the securement members 86, 88 incorporate a hook and loop fastener, the first 86 and second 88 securement members may be either one or more strips of hook portion and/or loop portion, and the securement means 82 would be configured in a complementary arrangement of one or more strips of the hook and/or loop fastener material.

Furthermore, securement members and securement means contemplated herein may be attached to the encasement any other means that may form a parasite and/or insect, for example, bed bug impervious seal between the securement members and securement means and the zipper and support panel, respectively. For example, the securement members and securement means contemplated herein may be attached to the encasement via stitching, welding, and/or by an adhesive.

Figure 4:
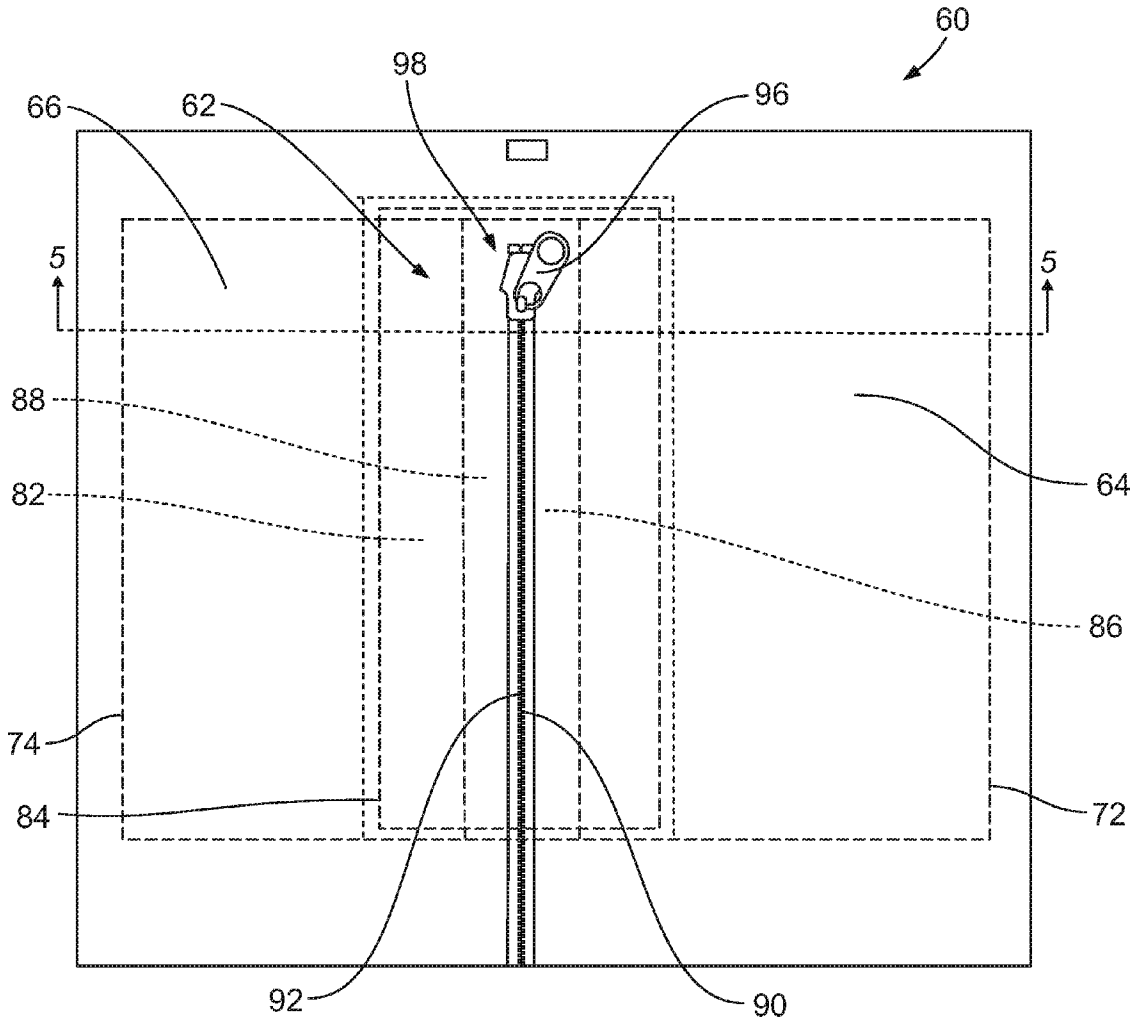
FIG. 4 is a top plan view of the closed zipper end stop of FIG. 3.
Figure 5:
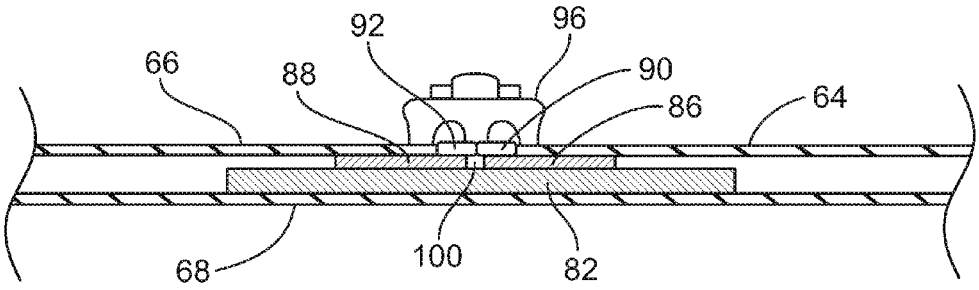
FIG. 5 is a sectional view of FIG. 4 taken substantially along line 5-5.

FIG. 4 depicts the zipper end stop 60 of FIG. 3 in a closed state, with the zipper pull 96 abutting the closed end 98 of the zipper 62 and the securement members 86, 88 aligned atop the securement means 82 to form an impassible channel (not shown) beneath the enmeshed complementary zipper tracks 90, 92, FIG. 5 is a sectional view of the zipper end stop 60 along lines 5-5. Here, the first 90 and second 92 complementary zipper tracks are enmeshed behind the zipper pull 96. Directly beneath the enmeshed tracks 90, 92, the first 86 and second 88 securement members are attached and/or adhered and/or bonded to first securement means 82, which is attached to the support panel 68. An impassible channel 100 is formed in a space between the enmeshed tracks 90, 92 above, the securement members 86, 88 on the sides, and the securement means 82 below.

Figure 6:
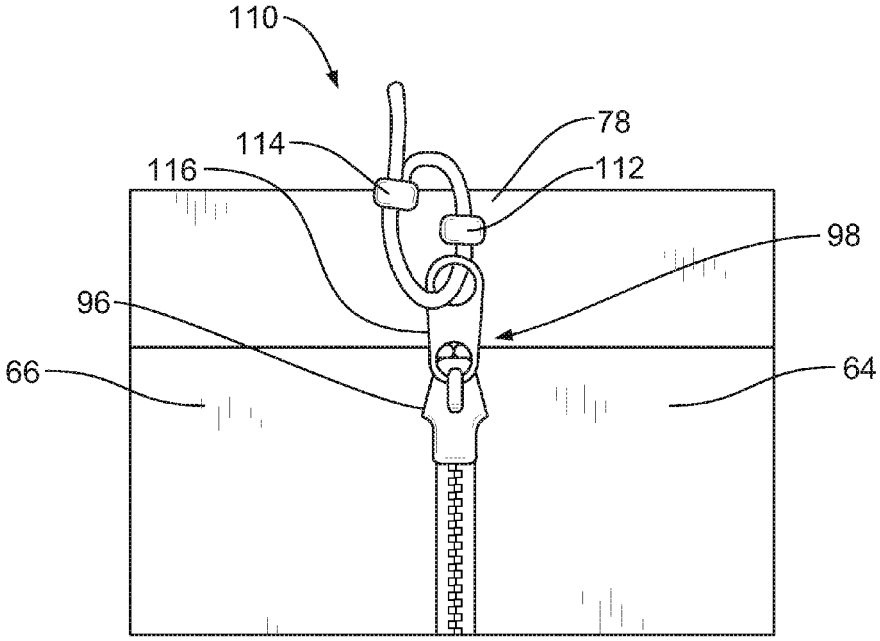
FIG. 6 is a top plan view of a zipper lock.

In another embodiment depicted in FIG. 6, encasements of the present disclosure further may include a zipper lock 110 that releasably secures the zipper pull 96 to the closed end 98. The zipper lock 110 may provide a tamperproof mechanism, such as that shown in FIG. 6, for maintaining the encasement in a sealed configuration. It may be desired to have tamperproof mechanisms, for example, in public places, such as in a motel, a hotel, and the like or in a child's room. The zipper lock 110 may include an anchor site 112 attached to the side wall 78 adjacent the closed end 98. The zipper lock 110 further may include an anchor tie 114 for securing the zipper pull 96 to the anchor site 112 by means of attaching the tab 116 of the zipper pull 96 to the anchor site 112. In one embodiment, the anchor site 112 may be a loop of material sewn onto the side wall 78 or a set of very tight zig-zag stitches (not shown). Further, the anchor tie 114 may be, for example, a thread, a pin, a wire, a hook, a cable tie, a ring, a fastener, an adhesive, a magnet, and combinations thereof. When the encasement needs to be opened, the anchor tie may be removed or cut and replaced at a later time to reseal the encasement. However, all manner of appropriate zipper locks are contemplated for use herein, including those disclosed in U.S. Pat. Nos. 4,815,176, 5,279,009, 5,586,368, 6,105,213, 6,189,249, 6,357,086, 7,200,901, 7,487,560, 7,552,489, and 7,849,543, which are incorporated by reference.

INDUSTRIAL APPLICATION

The devices disclosed herein allow for the protection of bedding items, including, for example, mattresses, box springs, cushions, pillows, and the like. By protecting bedding items in the disclosed devices, the useful life of the bedding items may be extended by preventing bed bug infestation.

The disclosure has been presented in an illustrative manner in order to enable a person of ordinary skill in the art to make and use the disclosure, and the terminology used is intended to be in the nature of description rather than of limitation. It is understood that the disclosure may be practiced in ways other than as specifically disclosed, and that all modifications, equivalents, and variations of the present disclosure, which are possible in light of the above teachings and ascertainable to a person of ordinary skill in the art, are specifically included within the scope of the impending claims. AU patents, patent publications, patent applications, and other references cited herein are incorporated by reference.

What is claimed is:

1. An encasement for a bedding item, comprising:

a cover comprising a top portion, a bottom portion, and a side wall attaching the top portion to the bottom portion;

an opening in the side wall sized to permit a bedding item to be removably inserted into an interior of the encasement;

a zipper disposed in the opening of the side wall configured to reversibly seal the encasement, the zipper comprising a) an open end, b) a closed end, c) a zipper pull, and d) opposing complementary zipper tracks; and a zipper end stop disposed at the closed end of the zipper, the zipper end stop comprising a) an interior support panel attached to the top portion and the bottom portion of the cover beneath the zipper, b) a first securement means affixed to the interior support panel adjacent the zipper tracks, and c) a plurality of securement members associated with the opposing complementary zipper tracks, wherein movement of the zipper pull from the open end to the closed end closes the opening to seal the encasement and secures the complementary securement members to the first securement means to form a bed bug impervious seal.

2. The encasement of claim 1, further comprising a zipper lock that secures the zipper pull at the closed end to prevent the zipper from opening.

3. The encasement of claim 2, wherein the zipper lock comprises an anchor site attached to the side portion and an anchor tie for securing the zipper pull to the anchor site.

4. The encasement of claim 3, wherein the anchor tie comprises at least one of a thread, a pin, a wire, a hook, a cable tie, a ring, a fastener, an adhesive, a magnet and combinations thereof.

5. The encasement of claim 1, wherein the top portion and the bottom portion are each comprised of a first material comprising a bed bug bite proof material.

6. The encasement of claim 5, wherein the side wall comprises a second material that enables greater gas exchange between the interior of the encasement and the exterior compared to the first material.

7. The encasement of claim 6, wherein the second material comprises at least one of a cotton, a cotton blend, a micro fiber, a polyester fiber, a polyester fiber blend, a recycled textile, a blended textile, wool, a wool blend, lyocell, a cellulose fiber, a textile with an elastic fiber content, silk, a silk blend, a nonwoven, and combinations thereof.

8. A bed bug encasement, comprising:

a cover comprising a top portion attached to a bottom portion via a side wall, wherein the top portion and the bottom portion are bed bug bite proof;

an opening in the side wall sized to permit a bedding item to be removably inserted into an interior of the encasement;

a zipper disposed in the opening of the side wall configured to reversibly seal the encasement, the zipper comprising a zipper pull and opposing complementary zipper tracks; and a zipper end stop disposed at a closed end of the zipper and comprising a) an interior support panel attached to the top portion and the bottom portion of the cover beneath the zipper, b) a first securement means affixed to the interior support panel adjacent the zipper tracks, and c) a plurality of securement members associated with the opposing complementary zipper tracks, wherein closure of the zipper associates the zipper pull with the closed end to close the opening and secures the complementary securement members to the first securement means to form a bed bug impervious seal.

9. The encasement of claim 8, wherein the first securement means and the securement members together comprise at least one of a hook and loop fastener, an adhesive, an adhesive silicone, a magnet and ferrous material, or complementary male and female mating strips of a plastic zipper.

10. The encasement of claim 9, further comprising a zipper lock comprising an anchor site attached to the side portion and an anchor tie for securing the zipper pull to the anchor site.

11. The encasement of claim 8, wherein the top portion and the bottom portion are affixed to the side wall by at least one of a stitched seam, a weld, or an adhesive.

12. The encasement of claim 8, wherein the side wall enables greater gas exchange between the interior of the encasement and the exterior compared to the top portion and the bottom portion.

13. The encasement of claim 8, further comprising a bed bug proof vent.

14. A bed bug invasion and escape-proof encasement, comprising:

a cover comprising a top portion attached to a bottom portion via a side wall, wherein the top portion and the bottom portion are bed bug bite proof;

an opening in the side wall sized to permit a bedding item to be removably inserted into an interior of the encasement;

a zipper disposed in the opening of the side wall configured to reversibly seal the encasement, the zipper comprising a zipper pull and a first zipper track and a second zipper track; and a zipper end stop disposed at a closed end of the zipper and comprising a) an interior support panel attached to the top portion and the bottom portion of the cover beneath the zipper, b) a strip of loop material affixed to the interior support panel having a width greater than the zipper tracks when enmeshed, and c) a first strip of hook material attached to an inner surface of the first zipper track and a second strip of hook material attached to an inner surface of the second zipper track, wherein closure of the zipper reversibly fastens the first strip of hook material and the second strip of hook material to the strip of loop material to form a seal that prevents a bed bug from passing through the zipper end stop.

15. The encasement of claim 14, further comprising a zipper lock that secures the zipper pull at the closed end to prevent the zipper from opening.

16. The encasement of claim 14, wherein the side wall material helps to prevent molding of a bedding item sealed therein.

17. The encasement of claim 16, wherein the bedding item comprises a mattress, a box spring, a pillow, a pad, or a cushion.

18. A method of preventing a bed bug from at least one of entering or exiting a bedding item, comprising placing a bedding item inside the encasement of claim 1; and sealing the encasement by closing the zipper to prevent a bed bug from passing through the zipper end stop.

19. The encasement of claim 1, further comprising a layer of cushioning associated with at least one of the top layer or the bottom layer.

20. The encasement of claim 16, wherein the layer of cushioning comprises at least one of a foam, a gel, feathers, a fabric, micro beads, or a combination thereof.

* * * * *